US006680700B2

(12) United States Patent
Hilgers

(10) Patent No.: US 6,680,700 B2
(45) Date of Patent: Jan. 20, 2004

(54) MINIATURIZED MICROWAVE ANTENNA

(75) Inventor: Achim Hilgers, Aachen (DE)

(73) Assignee: Koninklijke Philips Electronics N.V., Eindhoven (NL)

( * ) Notice: Subject to any disclaimer, the term of this patent is extended or adjusted under 35 U.S.C. 154(b) by 34 days.

(21) Appl. No.: 09/973,308

(22) Filed: Oct. 9, 2001

(65) Prior Publication Data

US 2002/0067312 A1 Jun. 6, 2002

(30) Foreign Application Priority Data

Oct. 9, 2000 (DE) ..... 100 49 844

(51) Int. Cl.[7] ..... H01Q 1/38
(52) U.S. Cl. ..... 343/700 MS; 343/702
(58) Field of Search ..... 343/700 MS, 702, 343/846, 848, 895

(56) References Cited

U.S. PATENT DOCUMENTS 6,111,544 A * 8/2000 Dakeya et al. ..... 343/700 MS
6,281,848 B1 * 8/2001 Nagumo et al. ..... 343/700 MS
6,396,460 B2 * 5/2002 Tseng et al. ..... 343/895

FOREIGN PATENT DOCUMENTS

EP 0762538 A2 3/1997 ..... H01Q/9/04

* cited by examiner

*Primary Examiner*—James Clinger
(74) *Attorney, Agent, or Firm*—Jack D. Slobod

(57) ABSTRACT

A miniaturized antenna is described with at least a ceramic substrate (10) and a metallization, particularly designed for use in the high-frequency and microwave ranges. The antenna is characterized in that the metallization is a surface metallization which is formed by a feed terminal (12) for electromagnetic energy to be radiated, by at least a first metallization structure (30), and by a conductor track (20) extending along at least part of the circumference of the substrate (10), which track connects the feed terminal to the at least one first metallization structure (30), which first metallization structure (30) comprises a first conductor track portion (31) extending from a side of the substrate lying opposite the feed terminal (12) towards the feed terminal and a first metallization pad (32). The antenna can be provided on a printed circuit board by surface mounting and has a great impedance and radiation bandwidth, so that it is particularly suitable for use in mobile telephones operating in the GSM and UMTS bands.

19 Claims, 4 Drawing Sheets

MINIATURIZED MICROWAVE ANTENNA

BACKGROUND OF THE INVENTION

1. Field of the Invention

The invention relates to a miniaturized antenna with at least a ceramic substrate and a metallization, in particular for use in the high-frequency and microwave range. The invention further relates to a printed circuit board and a mobile telecommunication device with such an antenna.

2. Description of the Related Art

Following the trend towards ever smaller electronic components, in particular in the field of telecommunication technology, all manufacturers of passive and/or active electronic components are intensifying their activities in this field. Particular problems then arise especially with the use of electronic components in the high-frequency and microwave technology fields, because many properties of the components are dependent on their physical dimensions. This is based on the generally known fact that the wavelength of the signal becomes smaller with increasing frequency, which again has the result that the supplying signal source is influenced in particular by reflections.

It is in particular the structure of the antenna of such an electronic device, for example a mobile telephone, which is more strongly dependent on the desired frequency range of the application than that of any other HF component. This is caused by the fact that the antenna is a resonant component which is to be adapted to the respective application, i.e. the operating frequency range. In general, wire antennas are used for transmitting the desired data. Certain physical lengths are absolutely necessary for obtaining good radiation and reception properties for these antennas.

So-called $\lambda/2$ dipole antennas, whose length corresponds to half the wavelength ($\lambda$) of the signal in open space, have optimum radiation properties. The antenna is composed of two wires each $\lambda/4$ long which are rotated through 180° with respect to one another. Since these dipole antennas are too large for many applications, however, in particular for mobile telecommunication (the wavelength for the GSM900 range is, for example, approximately 32 cm), alternative antenna structures are utilized. A widely used antenna in particular for the mobile telecommunication bands is the so-called $\lambda/4$ monopole. This is formed by a wire with a length of $\lambda/4$. The radiation behavior of this antenna is acceptable while at the same time its physical length (approximately 8 cm for GSM900) is satisfactory. This type of antenna in addition is characterized by a great impedance and radiation bandwidth, so that it can also be used in systems which require a comparatively great bandwidth. To achieve an optimum power adaptation to 50 Ω, a passive electrical adaptation is chosen for this type of antenna, as is also the case for most $\lambda/2$ dipoles. This adaptation is usually formed by a combination of at least one coil and a capacitance, which adapts the input impedance of the $\lambda/4$ monopole different from 50 Ω to the connected 50 Ω components by a suitable dimensioning.

Although antennas of this type are widely used, they do have considerable disadvantages. One of these is the passive adaptation circuit mentioned above.

Furthermore, the $\lambda/4$ monopoles cannot be directly soldered onto the printed circuit board because the wire antennas are mostly used as pull-out members, for example in mobile telephones. This means that expensive contacts are necessary for the information exchanged between the printed circuit board and the antenna.

A further disadvantage of antennas of this type is the mechanical instability of the antenna itself as well as the adaptation of the housing to the antenna made necessary by this instability. If a mobile telephone, for example, is dropped, the antenna will usually break off, or the housing is damaged in that location where the antenna can be pulled out.

Chip antennas with a substrate and at least one conductor are indeed known from EP 0 762 538. These antennas, however, have the disadvantage that at least portions of the conductor tracks extend inside the substrate, and that accordingly the substrate is to be manufactured in several layers and with a certain minimum size, which may be comparatively expensive. In addition, it is not possible with this arrangement of the conductor tracks to carry out an electrical adaptation of the conductor tracks to a concrete constructional situation in the finished state, because the conductor track is no longer accessible, or only partly accessible.

SUMMARY OF THE INVENTION

The invention accordingly has for its object to provide an antenna with at least a ceramic substrate and a metallization, in particular for use in high-frequency and microwave ranges, which has a high mechanical stability and is particularly suited for miniaturization.

Furthermore, an antenna is to be provided which renders it possible to dispense at least substantially with passive adaptation circuits and which is also suitable for surface mounting by the SMD (surface mounting device) technology on a printed circuit board.

Finally, an antenna is to be provided with a sufficiently great resonance frequency and impedance bandwidth for operation in the GSM or UMTS bands.

This object is achieved by an antenna having a surface metallization which is formed by a feed terminal for electromagnetic energy to be radiated, at least a first metallization structure, and a conductor track extending along at least a portion of the circumference of the substrate, which track connects the feed terminal to the at least one first metallization structure, while said first metallization structure comprises a first conductor track portion extending from a side of the substrate opposite the feed terminal towards the feed terminal and comprises a first metallization pad.

This solution combines many advantages. Since the feed terminal is part of the metallization present on the surface of the substrate, no contact pins or similar items are required for feeding-in of the electromagnetic energy to be radiated. This means that the antenna can be provided by surface mounting (SMD technology) on a printed circuit board (together with the other components). The size of the antenna can also be further reduced thereby, and the antenna is mechanically substantially more stable and insensitive to external influences.

It was also found that passive circuits for impedance adaptation are unnecessary, because such an adaptation can be achieved through a change in the fully accessible metallization (for example achieved by laser trimming) with the antenna in the incorporated state. It was also found that the antenna has a surprisingly great impedance and radiation bandwidth.

BRIEF DESCRIPTION OF THE DRAWINGS

Further details, characteristics, and advantages of the invention will become clear from the ensuing description of preferred embodiments, given with reference to the drawing, in which.

DETAILED DESCRIPTION OF THE PRESENTLY PREFERRED EMBODIMENTS

The embodiments to be described below comprise a substrate consisting of a substantially rectangular block whose height is approximately a factor 3 to 10 smaller than the length or width. Accordingly, the following description will refer to the upper and lower (larger) surfaces of the substrate as shown in the Figures as the first, upper and the second, lower surface, while the surfaces perpendicular thereto will be denoted the first to fourth side faces.

Alternatively, however, it is also possible to choose geometric shapes other than rectangular block shapes for the substrate, for example a cylindrical shape on which an equivalent resonant conductor track structure is provided, for example following a spiraling course.

The substrates may be manufactured by embedding a ceramic powder in a polymer matrix and have a dielectric constant of $\epsilon_r>1$ and/or a permeability value of $\mu_r>1$.

Figure 1:
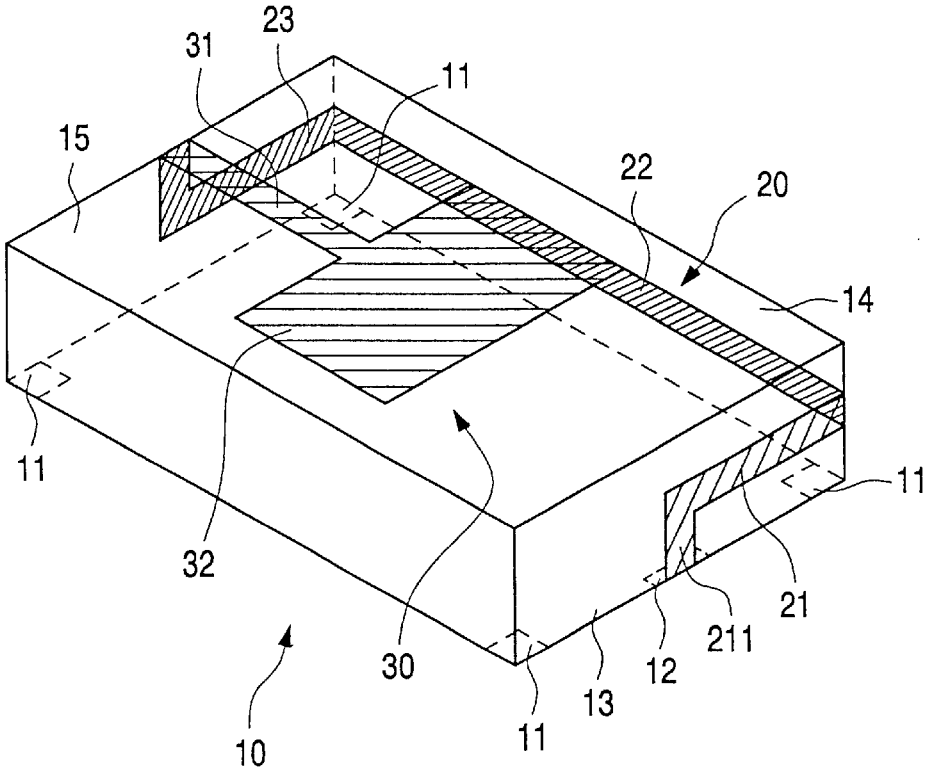
FIG. 1 diagrammatically shows a first embodiment of the invention.

More in detail, a first embodiment shown in FIG. 1 shows a rectangular block-shaped substrate 10 with a resonant conductor track structure 20, 30. The substrate 10 is provided with several soldering points 11, by which it can be soldered on a printed circuit board by surface mounting (SMD technology), at the corners of its lower surface. Furthermore, a feed terminal 12 is present at the lower side in the central region of a first side face 13 in the form of a metallization pad which is soldered to a corresponding conductor region on a printed circuit board during mounting and through which the antenna is supplied with electromagnetic energy to be radiated. Starting from the feed terminal 12, a first portion 21 of a conductor track 20 extends vertically to approximately halfway the height of the first side face 13 and then continues in horizontal direction along the first side face 13 to a second side face 14. The conductor track then continues in horizontal direction along the second side face 14 at approximately half its height as a second portion 22, and as a third portion 23 along a third side face 15 lying opposite the first side face 13 at about halfway its height. In the central region of the third side face 15, the third conductor track portion 23 then goes in vertical direction up to the upper surface, as shown in the picture, where it is connected to a first conductor track portion 31 of a (first) metallization structure 30 provided on this surface.

The metallization structure 30 comprises the first conductor track portion 31, which extends substantially in longitudinal direction of the substrate in the direction of the feed terminal 12, and a substantially rectangular metallization pad 32 into which the first conductor track portion 31 issues.

The effective length of the structure between the feed terminal 12 and the metallization pad 32 here corresponds to approximately half the wavelength of the signal to be radiated in the substrate.

It was surprisingly found that this antenna combines several advantageous properties. On the one hand, the antenna has a particularly high impedance bandwidth, while on the other hand the antenna has a very homogeneous, quasi-omnidirectional space pattern.

In an embodiment realized for the GSM900 band (approximately 890 to 960 MHz), the dimensions of the ceramic substrate were approximately 17×11×4 $mm^3$, and the total length of the resonant structure formed by the conductor track 20 and the metallization structure 30 was approximately 39 mm. Passive impedance adaptation circuits can be omitted in the case of these dimensions, because the input impedance of the antenna is approximately 50 Ω.

Figure 2:
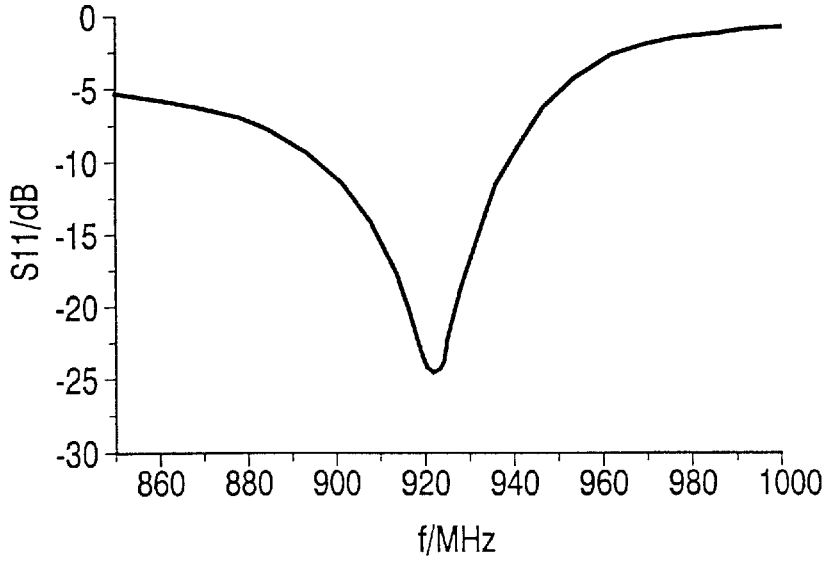
FIG. 2 shows an impedance spectrum measured for this embodiment.
Figure 3:
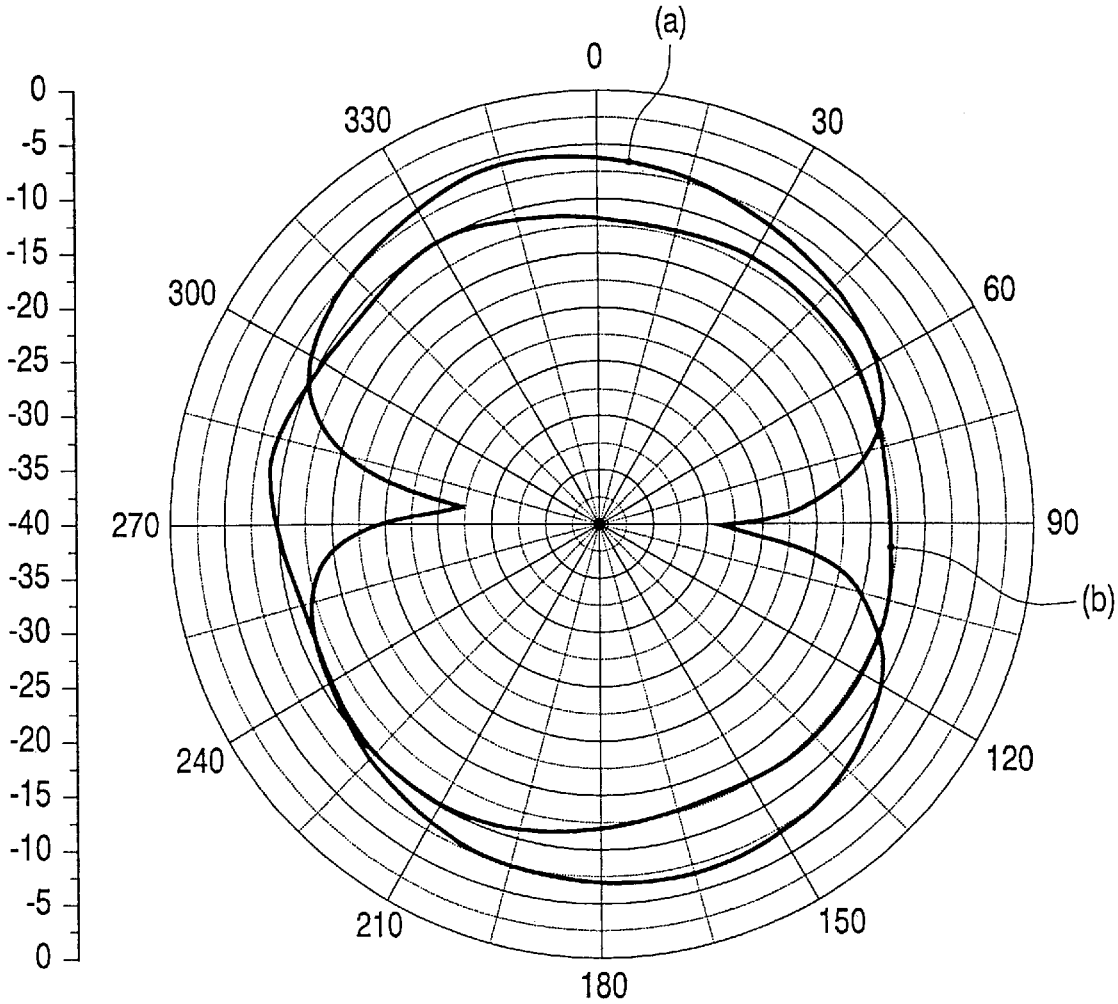
FIG. 3 shows a directional characteristic measured for this embodiment.

The impedance gradient shown in FIG. 2 as a function of frequency and the directional characteristic shown in FIG. 3, where the curve (a) represents the horizontal and the curve (b) the perpendicular space-characteristic, were found for this antenna. These curves show that the antenna behavior corresponds substantially to that of a dipole or monopole antenna.

This antenna is accordingly ideally suited for use in a mobile telephone device because it can be mounted (together with the other components) on a printed circuit board by surface mounting (SMD technology), whereby the manufacture is considerably simplified.

A further miniaturization in comparison with known wire antennas and a further increase in the frequency bandwidth, in particular of the first harmonic, can be achieved through changes in the shape of the ceramic substrate 10 and a further structuring of the resonant conductor track structure 20, 30.

A further advantage of this antenna is found in the fact that the input impedance of the antenna can be influenced and adapted to a concrete constructional situation through the creation of a slot 211 (air gap) between the feed terminal 12 and the first portion 21 of the conductor track. This is possible in the mounted state of the antenna, for example by laser trimming, whereby the width and/or the length of the gap (and thus the capacitive coupling between the feed terminal 12 and the resonant structure 20, 30) is increased with a laser beam until an optimum adaptation has been achieved.

To realize a preferred application of the antenna in a dual-mode or multimode mobile telephone device, the tuning is preferably performed such that the particularly great bandwidth of the first harmonic of the resonance frequency is used for covering the GSM bands. In this manner the antenna can also be constructed for use in the UMTS band (1970 to 2170 MHz).

Figure 4A:
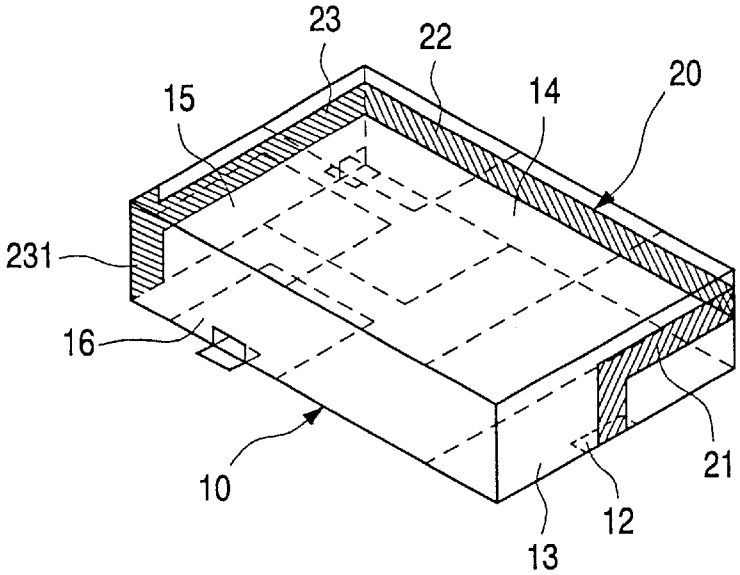
FIG. 4 shows a second embodiment of the invention.
Figure 4B:
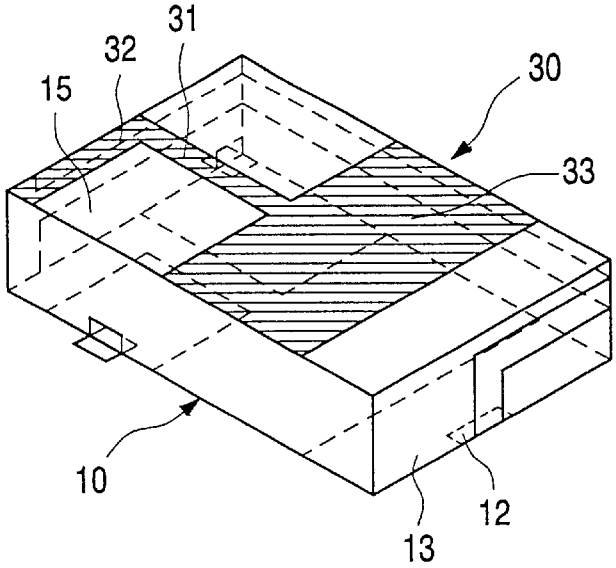
Figure 4C:
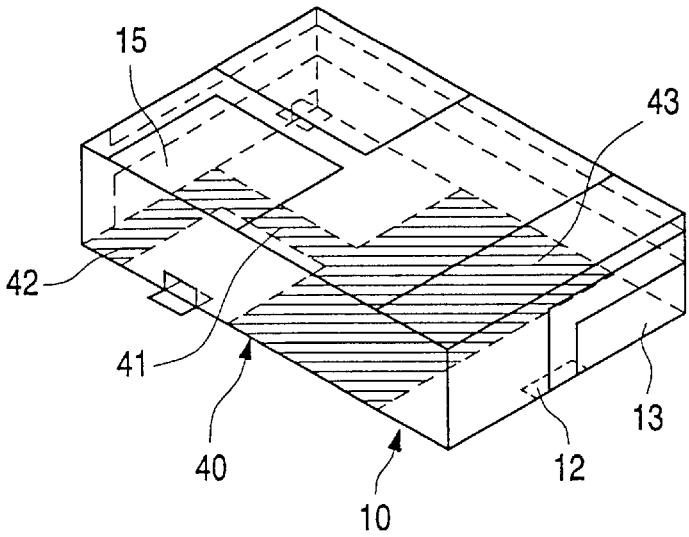

FIG. 4 shows a second embodiment of the antenna. This antenna is formed by a substrate 10 with a resonant metal conductor track structure 20, 30, 40, which is substantially composed of three parts, i.e. a common conductor track 20 in accordance with FIG. 4*a*, a first metallization structure 30 on the upper (first) surface of the substrate as shown in FIG. 4*b*, and a second metallization structure 40 on the opposite, lower (second) surface of the substrate as shown in FIG. 4*c*, which structures 30, 40 are supplied by the conductor track 20. These three parts are shown separately in one picture each for clarifying the construction.

In detail, a feed terminal 12 in the form of a metallization pad is arranged again at the lower side of the substrate 10 in the region of the center of a first side face 13, which pad during surface mounting of the antenna is soldered onto a conductor region via which the antenna is supplied with electromagnetic energy.

Starting from the feed terminal 12, a first portion 21 of the conductor track 20 extends first vertically over the first side face 13 towards the upper surface and then horizontally up to a second side face 14. The conductor track 20 continues as a second portion 22 further along the second side face 14 and as a third portion 23 along a side face 15 opposed to the first side face 13, where the third portion ends in a T-shaped end piece 231 at an edge adjoining a fourth side face 16, perpendicular thereto.

In FIG. 4*b*, the first metallization structure 30 is connected to an upper leg of the end piece 231 extending towards the upper surface, and comprises a first portion 31 similar to the first embodiment, which portion extends in longitudinal direction of the substrate 10 in the direction of the feed terminal 12 and finally issues into a first, substantially rectangular metallization pad 33. The first portion 31, however, is connected to the upper leg of the end piece 231 via a second conductor track portion 32 which runs along the edge adjoining the third side face 15.

Finally, FIG. 4*c* shows a lower leg of the end piece 231 which extends towards the lower surface, to which the second metallization structure 40 is connected, which structure is formed in a similar manner as the first metallization structure 30 by a first portion 41 which extends in longitudinal direction of the substrate towards the feed terminal 12 and finally issues into a second, substantially rectangular metallization pad 43. Here, also, a second portion 42 is provided which runs along the edge adjoining the third side face 15 and which achieves a connection between the lower leg of the end piece 231 and the first portion 41.

The effective length of the structures between the feed terminal 12 and the first metallization pad 33 as well as between the feed terminal 12 and the second metallization pad 43 again corresponds to approximately half the wavelength of the signal to be radiated in the substrate.

This second embodiment of the antenna can also be mounted on a printed circuit board by surface mounting (SMD technology). Furthermore, a very homogeneous, quasi-omnidirectional space pattern both in horizontal direction and in the direction perpendicular thereto can be achieved again.

It was also found that two resonance frequencies are excited if the two metallization structures 30, 40 are slightly different, i.e. have different lengths or widths, with different couplings (for example by a gap 211 of variable width and/or length) to the joint conductor track 20, or with different dimensions of the first and second metallization pads 33, 43, which frequencies are mutually shifted in accordance with these differences. In that case, for example, the first metallization structure 30 will have a somewhat lower resonance frequency than the second metallization structure 40.

The number of these resonances can be increased in that, for example, one or several further substrates with identical or similar resonant conductor track structures 20, 30, 40 are provided on the substrate shown in FIG. 4. This is comparatively easy to realize in manufacturing technology, in particular with the use of multilayer technology. Furthermore, a further resonance can be generated between the substrates if a layered structure with two substrates is used.

The positions and distances of the resonance frequencies, which relates both to the fundamental modes and to the first harmonics of the resonance frequencies, may be adjusted as desired through a suitable choice of the dimensions of the substrates and of the resonant structures 20, 30, 40. This is also true for the adaptation of the antenna impedance to the feed terminal, for which purpose again an adaptation to a concrete constructional situation is possible through a suitable change in the capacitive coupling achieved by a variable gap 211, for example through lengthening and/or widening of the gap with a laser beam (laser trimming).

A further advantage of this embodiment arises in conjunction with the steepness of the impedance gradient in the region of the resonance frequencies. If the antenna is designed, for example, for a duplex operation, for which only two resonance frequencies are required (the transmission and reception frequencies), a filter effect can be achieved for the antenna between the transmission and reception frequencies through the steepness of this gradient, which may be utilized for reducing the requirements imposed on the filter circuits connected upstream or downstream, or even for eliminating these requirements completely. For this application, preferably, separate supplies are provided for the first and the second metallization structure 30 and 40.

It is possible also in this embodiment to realize a further miniaturization in comparison with known wire antennas through an adapted design of the ceramic substrate 10 and a corresponding structuring of the resonant conductor track structures 20, 30, 40.

In an embodiment realized for the GSM900 band (approximately 890 to 960 MHz), the dimensions of the ceramic substrate were approximately $17\times11\times4$ mm$^3$, and the total length of the conductor track 20 and the first metallization structure 30 and of the conductor track 20 and the second metallization structure 40 were each approximately 39 mm.

Figure 5:
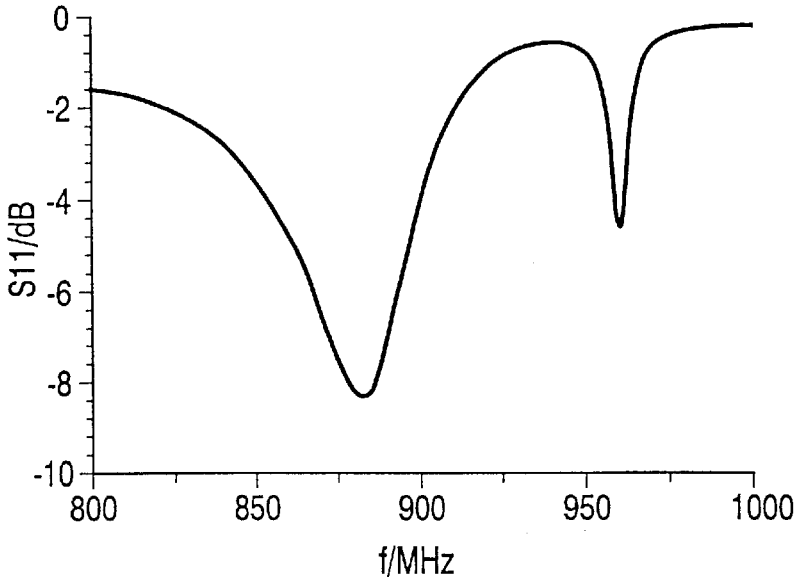
FIG. 5 shows an impedance spectrum measured for this embodiment.

This resulted in the impedance spectrum gradient shown in FIG. 5, in which the two resonance peaks are clearly distinguishable.

Figure 6:
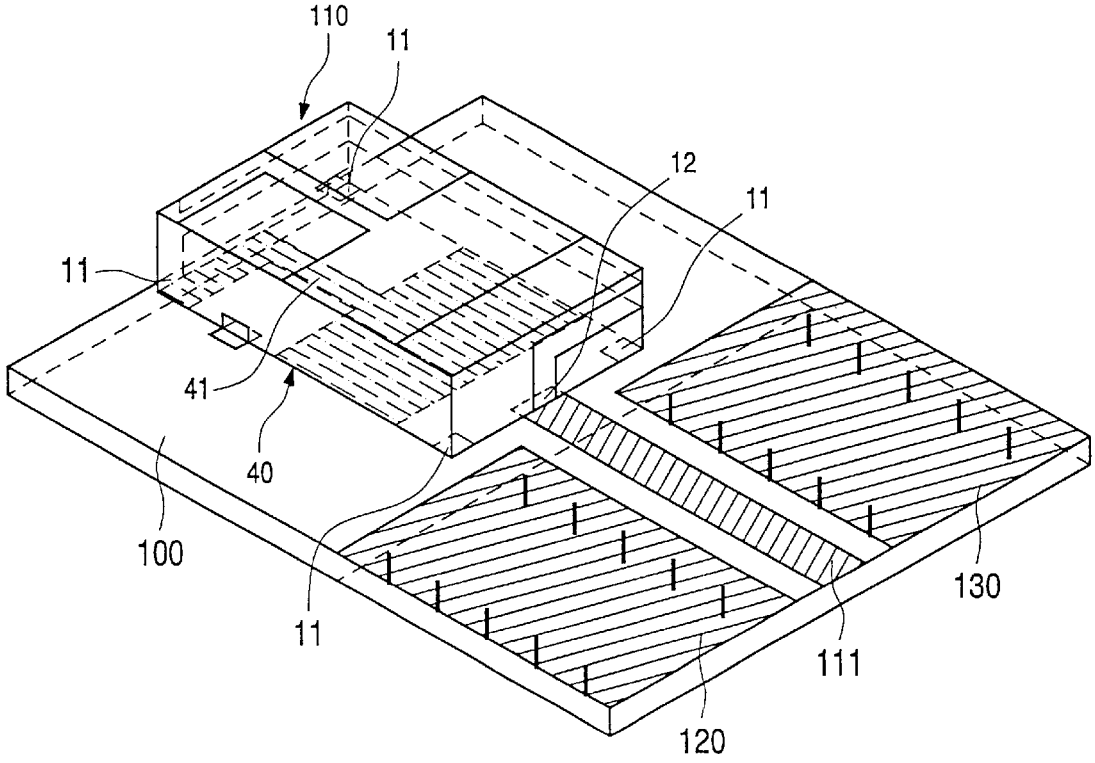
FIG. 6 shows a printed circuit board with an antenna according to the invention.

FIG. 6 finally and diagrammatically shows a printed circuit board (PCB) 100 on which an antenna 110 according to the invention is provided together with other components in regions 120 and 130 of the printed circuit board 100 by surface mounting (SMD). This is done by planar soldering in a wave soldering bath or in a reflow process, whereby the solder points (footprints) 11 and the feed terminal 12 are connected to corresponding solder points on the board 100. This achieves inter alia an electrical connection between the feed terminal 12 and a conductor track 111 on the board 100, via which the electromagnetic energy to be radiated is supplied to the antenna.

The antenna according to the invention, given a suitable dimensioning, may also be used in the GSM1800 (DCS) band, in the UMTS band, and in the Bluetooth band (BT band at 2480 MHz).

The antenna may also be composed from several ceramic substrates with identical or dissimilar dielectric and/or permeability properties, each with its own surface metallization.

While the embodiments of the invention disclosed herein are presently considered to be preferred, various changes and modifications can be made without departing from the spirit and scope of the invention. The scope of the invention is indicated in the appended claims, and all changes that come within the meaning and range of equivalents are intended to be embraced therein.

What is claimed is:

1. An antenna, comprising:

a substrate;

a feed terminal formed on an exterior of said substrate, said feed terminal operable to radiate electromagnetic energy;

a metallization structure formed on said exterior of said substrate, said metallization structure including a first conductor track and a metallization pad; and a second conductor track formed on said exterior of said substrate, said second conductor track connecting said feed terminal to said first conductor track, wherein said substrate has a first surface and a second surface, and wherein said second conductor track is formed on at least said first surface and said second surface of said substrate.

2. The antenna of claim 1, wherein said substrate has a third surface and a fourth surface;

wherein said feed terminal is formed on said third surface of said substrate; and wherein said metallization structure is formed on said fourth surface of said substrate.

3. The antenna of claim 2, wherein said substrate further has a fifth surface; and wherein said second conductor track is formed on said first surface, said second surface, and said fifth surface of said substrate.

4. The antenna of claim 1, wherein said second conductor track includes:

a first portion connected to said feed terminal; and a second portion connected to said metallization structure, wherein said first portion and said second portion are parallel.

5. The antenna of claim 4, wherein said second conductor track further includes a third portion perpendicular to said first portion and said second portion.

6. The antenna of claim 4, wherein said metallization structure is perpendicular to said first portion and said second portion of said second conductor track.

7. An antenna, comprising:

a substrate having a top surface, a bottom surface and a plurality of side surfaces;

a feed terminal formed on said bottom surface of said substrate, said feed terminal operable to radiate electromagnetic energy;

a metallization structure formed on said top surface of said substrate; and a conductor track formed on said plurality of side surfaces of said substrate, said conductor track connecting said feed terminal to said metallization structure.

8. The antenna of claim 7, wherein said plurality of side surfaces includes a first side surface and a second side surface;

wherein said conductor track includes a first portion formed on said first side surface and connected to said feed terminal; and wherein said conductor track further includes a second portion formed on said second side surface and connected to said metallization structure.

9. The antenna of claim 8, wherein said plurality of side surfaces further includes a third side surface; and wherein said conductor track further includes a third portion between said first portion and said second portion, said third portion being formed on said third side surface.

10. The antenna of claim 7, wherein said conductor track includes:

a first portion connected to said feed terminal; and a second portion connected to said metallization structure, wherein said first portion and said second portion are parallel.

11. The antenna of claim 7, wherein said conductor track further includes a third portion perpendicular to said first portion and said second portion.

12. An antenna, comprising:

a substrate having a first surface, a second surface, a third surface and a fourth surface;

a feed terminal formed on an exterior of said substrate, said feed terminal operable to radiate electromagnetic energy;

a first metallization structure formed on said first surface of said substrate;

a second metallization structure formed on said second surface of said substrate; and a first conductor track formed on said exterior of said substrate, said first conductor track connecting said feed terminal to both said first metallization structure and said second metallization structure, wherein said first conductor track comprises at least a first portion formed on said third surface and a second portion formed on said fourth surface of said substrate.

13. The antenna of claim 12, wherein said feed terminal is formed on said second surface of said substrate.

14. The antenna of claim 12, wherein said first conductor track includes a T-shaped end piece having a first leg connected to said first metallization structure and a second leg connected to said second metallization structure.

15. The antenna of claim 12, wherein said first metallization structure includes a second conductor track;

said second metallization structure includes a third conductor track; and said first conductor track includes a T-shaped end piece having a first leg connected to said second conductor track and a second leg connected to said third conductor track.

16. The antenna of claim 15, wherein said first portion of said first conductor track is connected to said feed terminal;

wherein said second portion of said first conductor track is connected to said first metallization structure, wherein said first portion of said first conductor track and said second portion of said first conductor track are parallel.

17. The antenna of claim 16, wherein said first conductor track further includes a third portion perpendicular to said first portion of said first conductor track and said second portion of said first conductor track.

18. The antenna of claim 16, wherein said second portion of said first conductor track is also connected to said second metallization structure.

19. The antenna of claim 18, wherein said second portion of said first conductor track includes a T-shaped end piece by which the said second portion of said first conductor track is connected to both said first metallization structure and said second metallization structure.

* * * * *